United States Patent [19]

Sorlien et al.

[11] Patent Number: 4,676,525

[45] Date of Patent: Jun. 30, 1987

[54] SKI POLE BASKET

[75] Inventors: Per H. Sorlien; Iver A. Helgaker, both of Oslo; Magne Halvorsen; Jan H. Rustad, both of Lillehammer, all of Norway

[73] Assignee: Trygve Liljedahl Skistavfabrikk A/S, Lillehammer, Norway

[21] Appl. No.: 536,904

[22] Filed: Sep. 28, 1983

[30] Foreign Application Priority Data

Oct. 1, 1982 [SE] Sweden ..... 8205599

[51] Int. Cl.[4] ..... A63C 11/24

[52] U.S. Cl. ..... 280/824

[58] Field of Search ..... 280/819, 824; 135/77–81, 84

[56] References Cited

U.S. PATENT DOCUMENTS

| | | | |
|---|---|---|---|
| 3,199,886 | 8/1965 | Dover | 280/824 |
| 3,963,254 | 6/1976 | Aho | 280/824 |

FOREIGN PATENT DOCUMENTS

| | | | |
|---|---|---|---|
| 2943290 | 2/1980 | Fed. Rep. of Germany | 280/824 |
| 53784 | 5/1978 | Finland | 280/824 |
| 2514653 | 4/1983 | France | 280/824 |
| 144871 | 8/1981 | Norway | 280/824 |
| 134406 | 2/1982 | Norway | 280/824 |
| 88489 | 2/1937 | Sweden | 280/824 |
| 375453 | 7/1975 | Sweden | 280/824 |

*Primary Examiner*—David M. Mitchell
*Assistant Examiner*—Eric Culbreth
*Attorney, Agent, or Firm*—Brumbaugh, Graves, Donohue & Raymond

[57] ABSTRACT

A ski pole basket (1) is described which is attached rigidly to a ski pole. The basket comprises an outwardly extending support surface (3) and is provided with a peak socket (4) directed downwards. By the peak socket being attached to the basket in front of the point where the basket is attached to the pole there is achieved an improved grip into the ground and an improved pendulum effect in the cycle of pole motion.

4 Claims, 4 Drawing Figures

SKI POLE BASKET

DESCRIPTION

1. Technical Field

Figure 1:
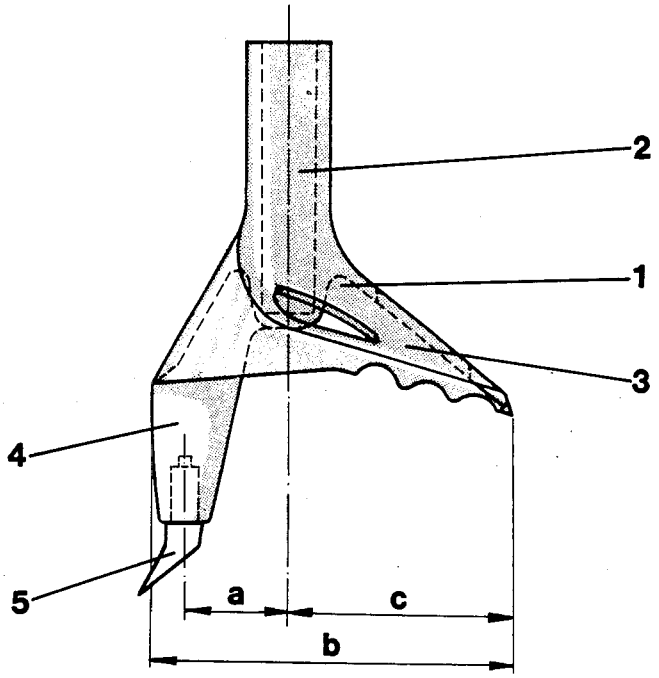

The present invention relates to a ski pole basket (or disk) arranged to be rigidly attached to a ski pole. The object of the invention is to obtain a basket which improves the grip of the ski pole in the snow, which is particularly important in the hard prepared snow tracks used in competitions. A further object is to provide a basket which facilitates the pendulum movement of the pole.

2. State of the Art

The traditional ski pole has a carrying member for the ski pole tip i.e. a socket which is a direct extension of the pole below the ring or basket, which is arranged as an annulus or disk attached to the pole. One way of improving the grip of the pole is presented in Finnish Pat. No. 53 784 wherein the ring is at an angle upwards and the ski pole tip socket is bent forwards. Constructors of ski poles have since long been aware of the possibility to displace, in a traditionally built pole, the snow ring backwards in the direction of skiing, thus that an unsymmetric attachment of the basket is obtained. This was illustrated e.g. in the year 1937 in Swedish Pat. No. 88 489. A more recent application of this thought is shown by Norwegian Pat. No. 134 406, wherein an unsymmetric ring of plastic is shaped thus that its front edge is in the immediate proximity of a vertical plane through the axis of the pole. Also in this case the pole tip socket is a direct extension of the pole. Swedish Pat. No. 7314624-3 shows a conically shaped ski pole basket wherein the pole is displaced unsymmetrically towards the front edge of the basket, which in addition to the through-going pole tip has a number of grip claws. A strongly unsymmetric arrangement of the support surface of the basket requires reinforcement to avoid that the lever action of the support surface breaks the basket on inserting the pole into hard ground, and further, the centre of gravity of a strongly unsymmetric basket will be behind the pole, which causes unfavourable dynamic properties.

DESCRIPTION OF THE INVENTION

According to the present invention the objects stated above are fulfilled and the drawbacks connected with previously known constructions are avoided. The invention provides a ski pole basket arranged to be rigidly attached to a ski pole, whereby the basket comprises an outwardly extending support surface and is provided with a tip socket directed downwards. The basket of the invention is characterized in that the tip socket is attached to the front part of the basket in front of the point where the basket is attached to the pole.

By "downwards" is understood the downward direction of the pole when held vertically in the position of use. By "in front of" is understood situated forwards in the direction of skiing.

In detail the ski pole basket according to a preferred embodiment of the invention may be described thus that the ski pole tip socket is arranged for attachment of a tip at a distance from an extension of the central axis of the ski pole.

The support surface of the basket may advantageously extend forwards to the front edge of the tip socket.

Figure 2:
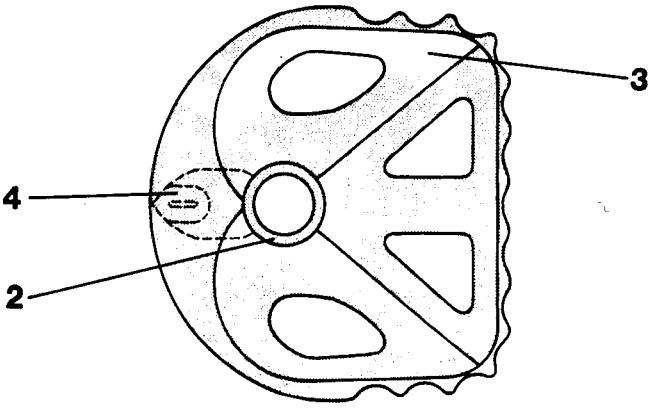
Figure 3:
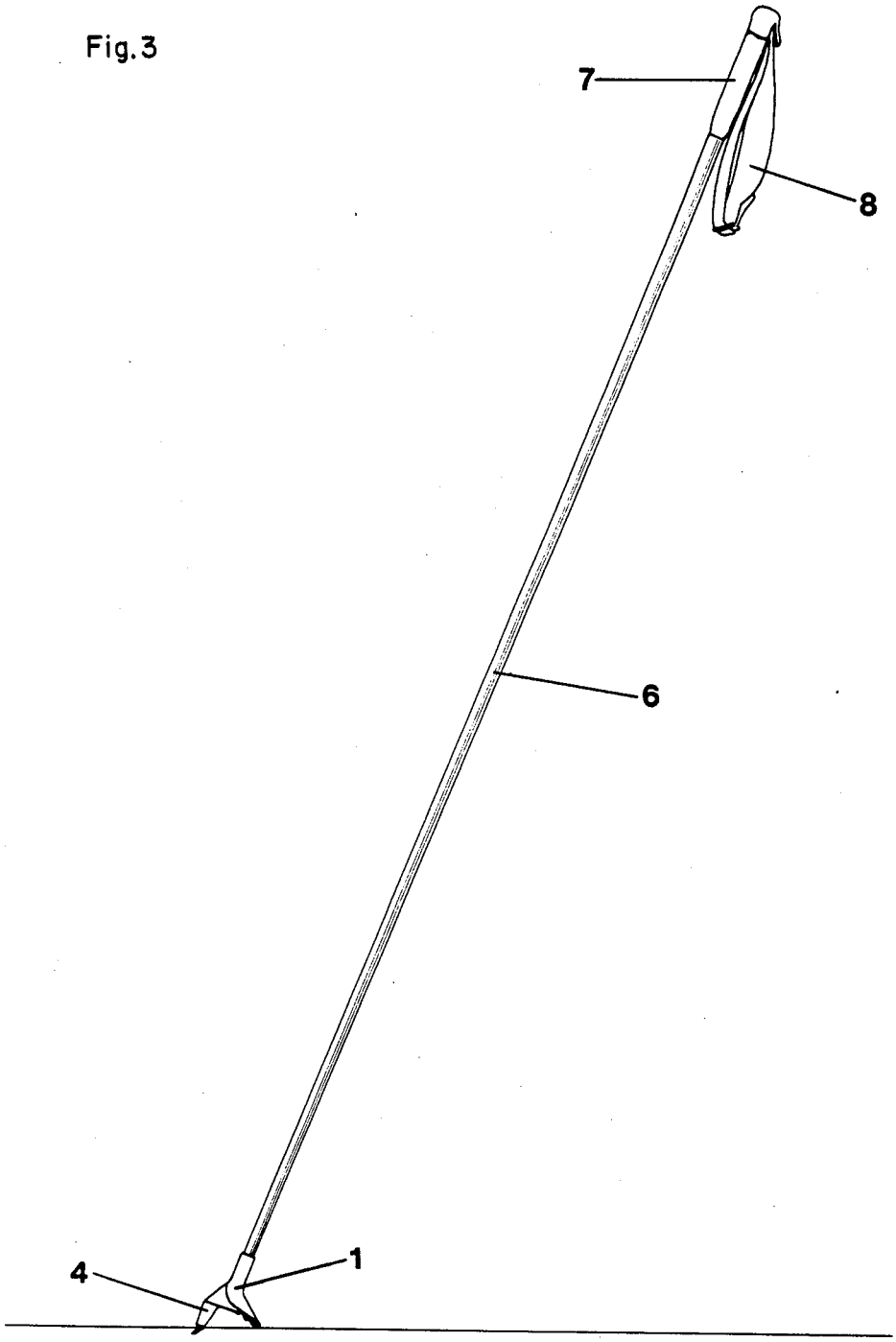
Figure 4:
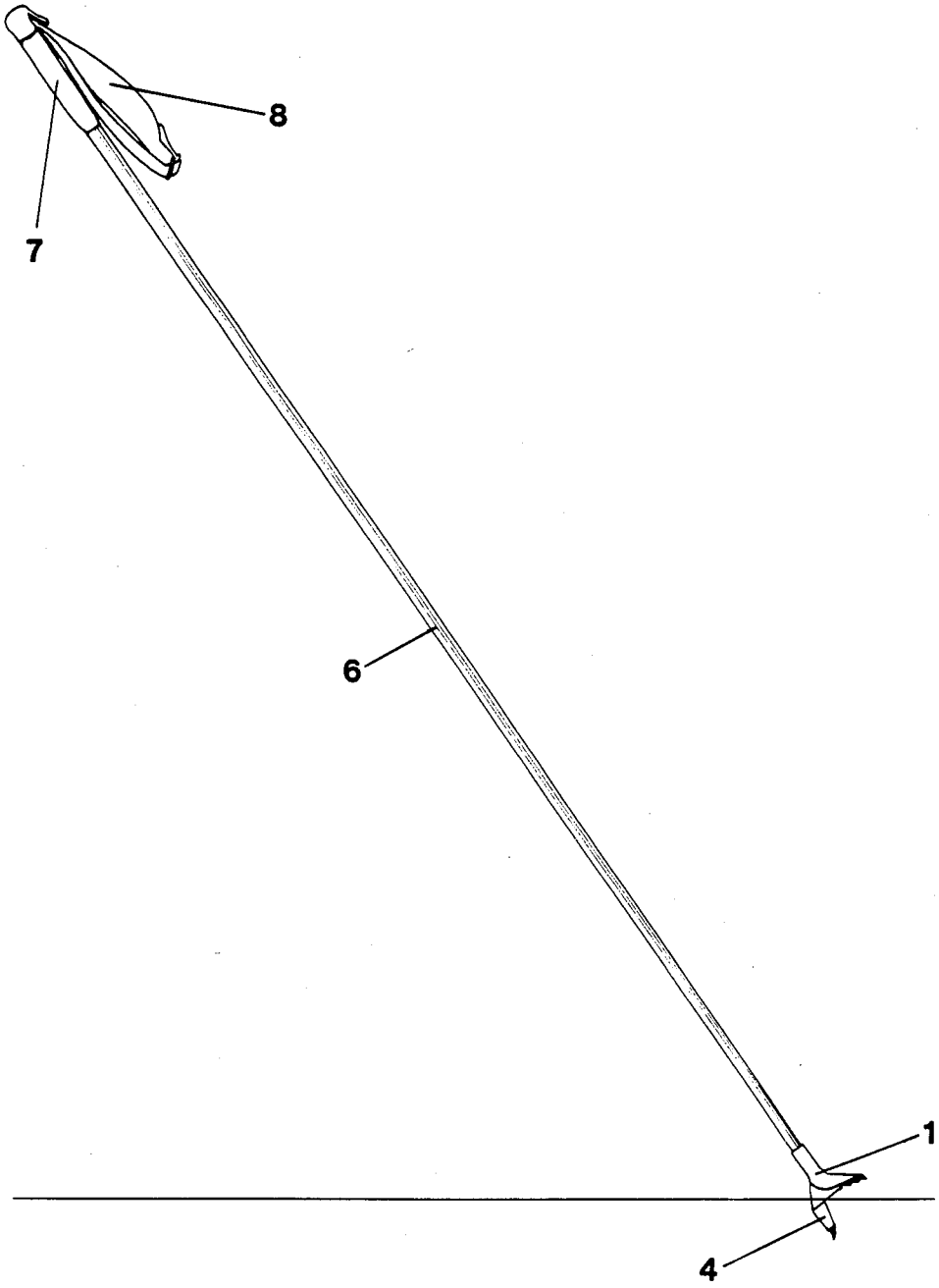

The invention is further described with reference to the enclosed drawings wherein FIG. 1 shows a side view of a ski pole basket according to a preferred embodiment of the invention, FIG. 2 shows the ski pole basket according to FIG. 1 viewed from above, FIG. 3 and FIG. 4 show a ski pole having attached thereto a basket according to the invention on a snow ground, whereby the pole in FIG. 3 is shown in beginning of a cycle of pole motion and the pole in FIG. 4 is shown at the end of a cycle of pole motion.

In the drawings a ski pole basket is denoted 1. Said basket has an attachment sleeve 2 in which the end of a ski pole tube can be attached. The support surface 3 of the basket extends outwards from said attachment sleeve and is bowl-shaped downwards. The ski pole tip socket 4 is attached in front of the attachment sleeve 2 for the ski pole tube in such way that said tip socket is substantially out of a theoretical downward extension of the ski pole tube. A ski pole tip is shown attached to the tip socket. The central axis of the cavity where the tip is attached is at a distance "a" from the central axis of the pole attachment sleeve 2. The distance "a" is about 30% of the distance "b" from the front edge of the basket to the rear edge of the basket. This ratio may be varied from about 20% to about 40%. The distance of the rear edge to the central axis of the pole attachment sleeve is denoted "c". The ski pole shown in FIGS. 3 and 4 is denoted 6 and has a basket 1 at its lower end mounted with the tip socket 4 forwardly in the direction of skiing. A handle 7 is arranged at the upper end of the ski pole having a hand strap 8 in the backward direction. In the beginning moment of the cycle of pole motion the ski pole tip penetrates into the ground thus that forward sliding is avoided. During the cycle of pole motion the tip socket 4 will penetrate into the ground to a greater or lesser degree and provides in the final moment of the cycle a firm grip into the ground and secures thereby a maximal use of force. Said grip is neither hindered by the support surface of the basket nor by the pole. The support surface will exert a grip into the ground during the cycle of motion which grip depends on the hardness of the ground. The invention provides for variation in the design of the support surface, which may be permitted to extend all round the attachment sleeve for the pole. Thus, the basket may be symmetric or weakly asymmetric in the direction of skiing as shown in FIG. 1 where the ratio of asymmetry "(b−c):c" is about 1:1.7. When the support surface grips into the ground the counterforces on the front and rear parts thereof will partly balance each other thus that the breaking forces which may occur in strongly asymmetric baskets are avoided.

With a ski pole basket according to the invention, by the eccentric location of the tip socket in front of the pole attachment sleeve, is achieved an improved balance which improves the pendulum effect in the cycle of pole motion. In combination with a pole tube tapered at its entire length, possibly with exception of a short cylindrical portion in the upper part the basket of the invention enables a further improved pendulum effect.

Suitably the basket with pole attachment sleeve and tip socket is manufactured in one piece in plastic material. The basket is attached rigidly to a ski pole and has a rigid connection to the tip socket while the support surface may be rigid or at least partly flexible.

What is claimed is:

1. A ski pole basket having (a) a basket with an outwardly extending support surface and a front-to-back axis of symmetry, (b) sleeve means along said axis and extending above said support surface for rigidly attaching said basket to a pole, (c) a single socket extending below said support surface to hold a ski pole tip mounted along said axis displaced ahead of said sleeve means such that the ratio of distance between the centerline of said socket and the centerline of said sleeve means to the total length of the support surface along said axis lies between 0.2 and 0.4, and (d) a tip mounted in said socket at the lower end thereof, the portion of the socket adjoining and laterally extending about said tip engaging the ground when said tip penetrates therein.

2. A ski pole basket according to claim 1, characterized in that the support surface of the basket extends forwards to the front edge of the tip socket.

3. The basket according to claim 1 wherein the ratio of (i) the distance along the said axis between the centerline of said means and the front edge of said basket to (ii) the distance along said centerline between the centerline of said means and the back edge of said basket is about 1:1.7.

4. The basket according to claim 1 wherein the tip mounted in said socket extends downwardly by a distance sufficient that said tip and the rear edge of said basket are adapted to grip the ground at substantially the same time at the beginning of a pole stroke, whereby the forces acting on the front and rear edges of the basket at least partly balance each other.

* * * * *